219-121 SR
6/23/87 OR 4,675,496

United States Patent [19]
Toyoshima et al.

[11] Patent Number: 4,675,496
[45] Date of Patent: Jun. 23, 1987

[54] METHOD AND APPARATUS FOR MAKING A CAN BODY

[75] Inventors: Makoto Toyoshima, Tokyo; Kikuo Kawamukai, Yokohama, both of Japan

[73] Assignee: Toyo Seikan Kaisha, Limited, Tokyo, Japan

[21] Appl. No.: 830,147

[22] Filed: Feb. 18, 1986

[30] Foreign Application Priority Data

Feb. 27, 1985 [JP] Japan ..... 60-38398

[51] Int. Cl.[4] ..... B23K 15/00; B23K 31/06; B23K 37/04

[52] U.S. Cl. ..... 219/121 LD; 72/51; 228/151; 228/44.3; 219/64

[58] Field of Search ..... 29/DIG. 95; 72/51, 52, 72/367, 368; 219/61.1, 61.11, 61.13, 64, 101, 102, 104, 121 LC, 121 LD, 123, 160; 228/44.1 R, 44.5, 151; 335/284, 285

[56] References Cited

U.S. PATENT DOCUMENTS

| | | | |
|---|---|---|---|
| 3,585,336 | 6/1971 | Suckow | 219/64 X |
| 4,497,995 | 2/1985 | Nilsen | 219/121 LC |
| 4,577,088 | 3/1986 | Sharp | 219/121 LD |

*Primary Examiner*—E. Michael Combs
*Attorney, Agent, or Firm*—Armstrong, Nikaido, Marmelstein & Kubovcik

[57] ABSTRACT

A method of making a can body is provided. The method comprises forming a ferromagnetic metal blank into a can body preform having adjacent confronting side edges whose edge faces are spaced, magnetizing the confronting edges to have a reverse polarity to each other, so that the confronting edge faces be attracted to each other and brought into abutting relationship to form an abutting portion, and joining the abutting portion. An apparatus for making a can body according to the method is also provided.

4 Claims, 4 Drawing Figures

METHOD AND APPARATUS FOR MAKING A CAN BODY

BACKGROUND OF THE INVENTION

The present invention relates to a method and apparatus for making a can body, more particularly to a method and apparatus for making a can body by jointing the side edges of a can body preform formed from a ferromagnetic metal sheet such as tinplate.

A can body having a side joint usually has been manufactured by forming a can body preform having an overlapped portion by overlapping the opposite edges of a metal blank of such as tinplate, and then welding or bonding with an adhesive the overlapped portion. The can body of this type has a step along the side joint, and thus is disadvantageous in that it is difficult to mend satisfactorily the joint with lacquers or the like and ensure hermetic sealability of the double-seamed portions of a can formed by double seaming top and bottom ends to the can body.

An art of making a can body by joining, preferably laser beam welding, the confronting side edges in edge-to-edge relationship without overlap is proposed in U.S. Pat. No. 4,152,573. In case of joining, particularly welding of this type, it is necessary to joining or welding the confronting edges in such abutting relationship that the edge faces thereof are in close contact with each other without substantial gap and step therebetween along the whole length, so as to obtain a joint or weld which has a thickness substantially equal to that of the metal sheet and is free of the step and pinholes.

It is, however, very difficult to bring the confronting edge faces of a relatively thin metal sheet blank of such as tinplate, usually of 0.15 to 0.25 mm thick into the above-mentioned abutting relationship.

Accordingly, in the aforementioned prior art the confronting side edges are clamped by means of two longitudinal parallel vices which are pressed together with clamping screws, so as to ensure the abutting relationship free of the gap and the step, that is, to avoid the possibility of creating pinholes and a surplus thickness at the weld.

This type of butt-joining or butt-welding is poor in productivity and unsuitable to a high speed production of the can body such as several hundreds can bodies per minute, since the confronting edges of the respective can body preform must be clamped by screwing, which is time-consuming.

SUMMARY OF THE INVENTION

The invention relates to a method and apparatus for making a can body by joining the confronting side edges of a can body preform formed of a ferromagnetic metal sheet in abutting relationship which is suitable to high speed production.

According to the invention there is provided a method of making a can body comprising: forming a ferromagnetic metal blank into a can body preform having adjacent confronting side edges whose edge faces are spaced, magnetizing the confronting edges to have a reverse polarity to each other, so that the confronting edge faces be attracted to each other and brought into abutting relationship to form an abutting portion, and joining the abutting portion. The joining may be preferably laser beam welding.

According to the invention, further there is provided an apparatus for making a can body comprising: a mandrel along which a can body preform having side edges is transferred, the can body preformed being formed from a ferromagnetic metal blank, means for allowing the side edges to confront adjacently to each other while the can body preform is transferred, a magnet which is disposed at the downstream side of the means for allowing the side edges to confront and adjacent a portion of the can body preform opposite to the side edges with respect to an axis of the mandrel, so as to magnetize the confronting side edges to reverse polarity to each other and attract the side edges to each other, whereby the confronting side edges are brought into abutting relationship to form an abutting portion, and means for joining the abutting portion. The means for joining may be a laser beam radiation means which is disposed opposite to the abutting portion to form an autogenous weld.

Other objects and advantages of the invention will be apparent from the following description and the accompanying drawings.

DETAILED DESCRIPTION OF THE PREFERRED EMBODIMENT OF THE INVENTION

Figure 1:
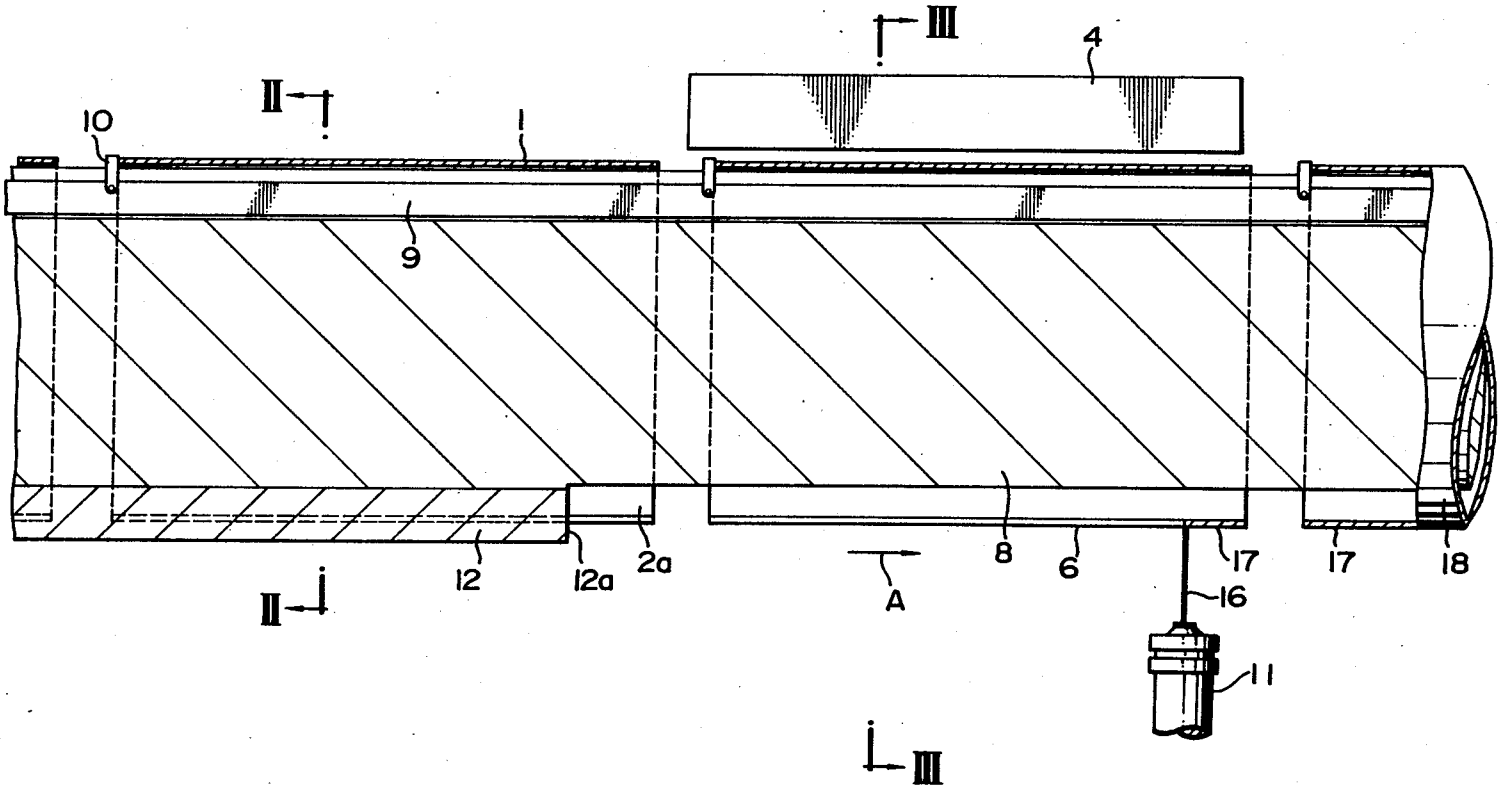
FIG. 1 is a partially sectional front view of an apparatus of an embodiment of the invention.

Referring to FIG. 1, a tubular can body preform 1 is formed from a rectangular blank of a ferromagnetic metal sheet such as black plate, a surface treated steel sheet, e.g. tinplate, tinfree steel, very-thinly nickel plated steel sheet and the like by means of a roll forming machine (not shown) or the like located at the left of a mandrel 8. The can body preform 1 whose confronting side edges 2*a*, 2*b* are spaced is pushed its rear edge surface by a finger 10 of a feed bar 9, and transferred one after another in the direction shown by arrow A along the mandrel 8. A stationary laser beam gun 11 is disposed below the downstream portion of the mandrel 8 so as to direct a laser beam 16 upwardly.

Figure 2:
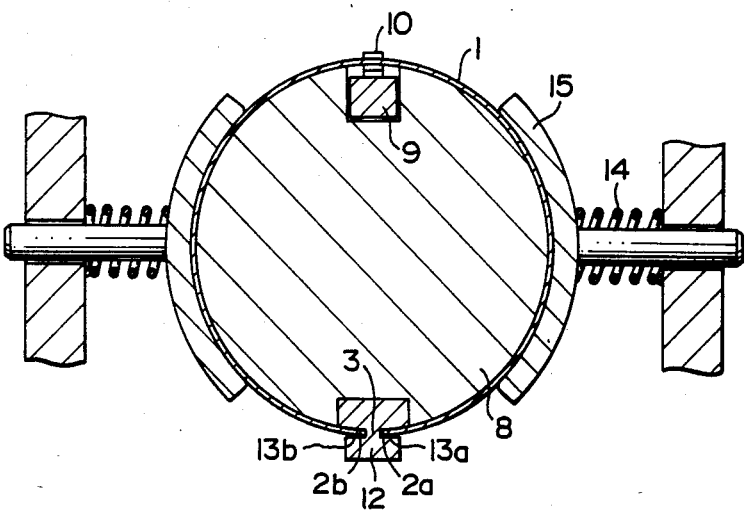
FIGS. 2 and 3 are vertical section views taken along line II—II and line III—III in FIG. 1, respectively.

Along the lower end of the upstream portion of the mandrel 8, as best shown in FIG. 2, is disposed a guide bar 12 through which the side edges 2*a*, 2*b* of the can body preform 1 are guided. The guide bar 12 is formed with a pair of confronting horizontal grooves 13*a* and 13*b* through which the side edges 2*a* and 2*b* pass respectively. Along both the sides of the upstream portion of the mandrel 8 are disposed pushing means 15 for pushing the sides of the can body preform 1 against the mandrel 8 which pushing means is biased radially, inwardly by means of a spring 14.

The can body preform 1, with both the sides pushed by the pushing means 15 and the side edges 2*a* and 2*b* passing through the grooves 2*a* and 2*b*, respectively, and thus forming a gap 3 therebetween, is transferred toward the laser beam gun 11 along the upstream portion of the mandrel 8.

Figure 3:
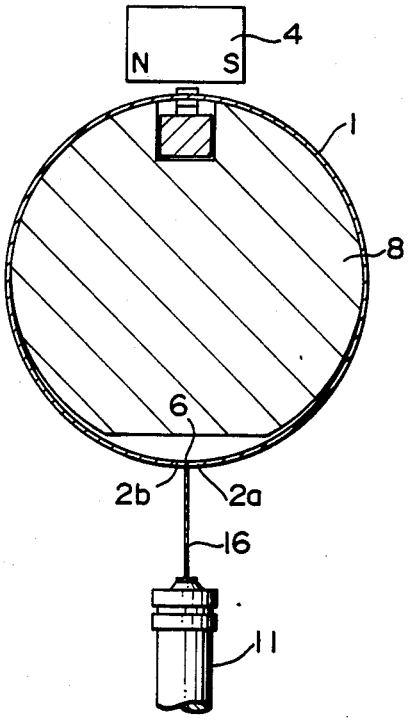

As shown in FIG. 1 and FIG. 3, an elongated permanent magnet 4 is disposed above the portion of the mandrel 8 between the downstream end 12*a* of the guide bar 12 and the laser beam gun 11, such that it may magnetize the side edges 2*a* and 2*b* to a polarity reverse to each other, and thus attract the confronting edge faces $2a_1$ and $2b_1$ to each other against the elastic counterforce of the can body preform 1 until the edge faces $2a_1$ and $2b_1$ is abutted, that is, in edge-to-edge relationship. The magnet 4 may be an electromagnet.

In case of FIG. 3, the magnet 4 is disposed adjacent the can body preform 1 such that it extends in the direction of the axis of the preform 1 along the opposite side to the gap 3 with respect to the axis, and the south pole and the north pole are positioned above the side edges *2a* and *2b*, respectively.

Figure 4:
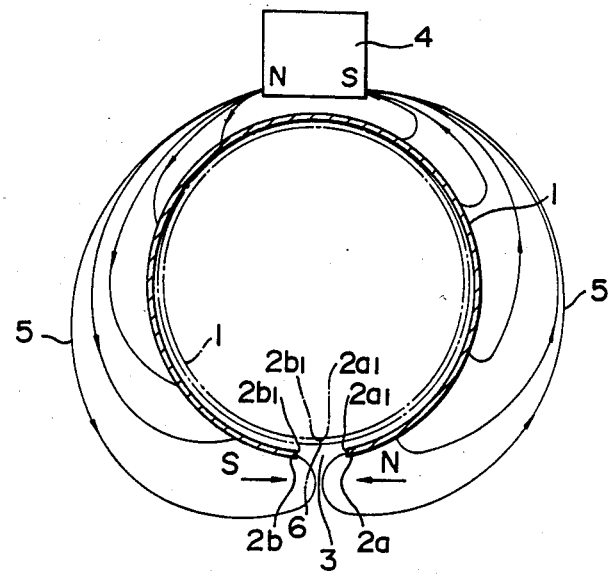
FIG. 4 is a schematic vertical sectional view of a can body preform which is subjected to magnetization.

As shown in FIG. 4, the can body preform 1, after having left the guide bar 12, is formed with lines of magnetic force 5, thus the side edges *2a* and *2b* are magnetized to the north pole and the south pole, respectively, and while moving in the direction shown by arrow A, the adjacent confronting edge faces $2a_1$ and $2b_1$ which have been spaced through the gap 3, are attracted to each other and abutted. Thus the edge faces $2a_1$ and $2b_1$ forms an abutting portion 6, as shown in the can body preform 1 of dotted lines in FIG. 4, at the upstream side of the laser beam gun 11.

The abutting portion 6 along the whole length has no substantial gap in accordance with the finishing degree of the edge faces, that is, perfectly no gap in case of mirror finishing, and no substantial step since the side edges *2a* and *2b* form common inner and outer curved surfaces along their inner surfaces and outer surfaces, respectively.

The abutting portion 6 then is radiated with a laser beam 16 by means of the laser beam gun 11, and melt and solidified preferably in an innert gas atmosphere to form an autogenous weld 17, and a welded can body 18 is made. The weld 17 will have no defects such as pinhole and no step with the thickness substantially same as that of the metal sheet blank. The invention is suitable to high speed production, since the confronting side edges are automatically brought into edge-to-edge relationship as soon as the can body preform enters the magnetic field of the magnet.

The invention is not limited to the embodiment described and illustrated which have been given by way of example only. For example, joining may be done by applying an adhesive, soldering, brazing or the like.

What is claimed is

1. A method of making a can body comprising: forming a ferromagnetic metal blank into a can body preform having adjacent confronting side edges whose edge faces are spaced, transferring the can body preform along a mandrel while allowing the side edges to confront adjacently to each other, sufficiently magnetizing the confronting edges to have a reverse polarity to each other by a magnet means which is disposed adjacent a portion of the can body preform opposite to the side edges with respect to an axis of the mandrel to cause the confronting edge faces to be attracted to each other and brought into abutting relationship by such attraction to form an abutting portion, and joining the abutting portion.

2. A method of making a can body as claimed in claim 1, wherein the joining a laser beam welding.

3. Apparatus for making a can body comprising: a mandrel along which a can body preform having side edges is transferred, the can body preform being formed from a ferromagnetic metal blank, means for allowing the side edges to confront adjacently to each other while the can body perform is transferred, a magnet means for sufficiently magnetizing the confronting side edges to have a reverse polarity to each other and attract the side edges to each other, whereby the confronting side edges are brought into abutting relationship by such attraction to form an abutting portion, said magnet means being disposed at the downstream side of the means for allowing the side edges to confront and adjacent a portion of the can body perform opposite to the side edges with respect to an axis of the mandrel, and means for joining the abutting portion.

4. Apparatus for making a can body as claimed in claim 3, wherein the means for joining is a laser beam radiation means which is disposed opposite to the abutting portion to form an autogenous weld.

* * * * *